US008328907B2

(12) United States Patent
Taylor

(10) Patent No.: US 8,328,907 B2
(45) Date of Patent: Dec. 11, 2012

(54) COLLECTING PLATE CLEANING USING RESONANT FREQUENCY WAVE APPLICATION

(75) Inventor: Robert W. Taylor, Ponte Vedra Beach, FL (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 458 days.

(21) Appl. No.: 12/640,253

(22) Filed: Dec. 17, 2009

(65) Prior Publication Data

US 2011/0146486 A1 Jun. 23, 2011

(51) Int. Cl.
*B03C 3/76* (2006.01)

(52) U.S. Cl. ..... 95/76; 55/292; 55/293; 55/300; 55/304; 55/305; 96/32

(58) Field of Classification Search ..... 95/2, 74, 95/76; 96/18, 30–38; 55/292, 293, 295, 55/300, 304, 305
See application file for complete search history.

(56) References Cited

U.S. PATENT DOCUMENTS

| | | | | |
|---|---|---|---|---|
| 3,504,480 | A | 4/1970 | Copcutt et al. | |
| 3,631,792 | A * | 1/1972 | Bodine | 60/299 |
| 3,771,286 | A * | 11/1973 | Scott | 95/29 |
| 3,892,544 | A * | 7/1975 | Haupt | 96/18 |
| 4,032,307 | A * | 6/1977 | Sommerfeld | 95/282 |
| 4,036,610 | A | 7/1977 | Huppi | |
| 4,221,573 | A | 9/1980 | Hankins | |
| 4,255,775 | A | 3/1981 | Andrews | |
| 4,285,024 | A | 8/1981 | Andrews | |
| 4,413,225 | A * | 11/1983 | Donig et al. | 323/246 |
| 5,900,043 | A * | 5/1999 | Grandjean et al. | 95/29 |
| 6,171,366 | B1 * | 1/2001 | Vicard et al. | 95/1 |
| 6,221,258 | B1 * | 4/2001 | Feke et al. | 210/748.05 |
| 7,413,593 | B2 * | 8/2008 | Altman et al. | 95/2 |
| 2009/0282641 | A1 * | 11/2009 | Black et al. | 15/352 |

FOREIGN PATENT DOCUMENTS

| | | | |
|---|---|---|---|
| EP | 551162 | A2 * | 7/1993 |
| GB | 2125314 | A * | 3/1984 |

* cited by examiner

*Primary Examiner* — Richard L Chiesa
(74) *Attorney, Agent, or Firm* — Eric Marich

(57) ABSTRACT

A system includes a resonant frequency modeler for determining a resonant frequency of a node on a collecting plate that collects particles from a gas flow; and a wave generating device that applies a wave having an applied frequency substantially equal to the resonant frequency to the node of the collecting plate to remove particles from the collecting plate. An electrostatic precipitator (ESP) including the system and related method are also provided.

18 Claims, 3 Drawing Sheets

COLLECTING PLATE CLEANING USING RESONANT FREQUENCY WAVE APPLICATION

BACKGROUND OF THE INVENTION

The disclosure relates generally to electrostatic precipitator (ESP) cleaning, and more particularly, to a system and method for cleaning collecting plates of an ESP by applying a resonant frequency wave.

Electrostatic precipitators (ESP), or electrostatic air cleaners, are particulate collection machines that pull particles from a moving gas such as air using an electrostatic charge on or commingled with the particles causing them to move perpendicular to gas flow and come to rest on the collecting plates. In industrial settings, cleaning of ESP collecting plates is accomplished using mechanical force, applied by hitting or rapping the collecting plates using a drop rod or tumbling hammer, which dislodges particles from the collecting plate to a hopper. Specific to electromagnetic rappers, the operator varies the lift height of the plunger, the number of times the plunger strikes and how frequently the rapper strikes. However, there is limited effort to vary the force based on debris load or position within the fields. It is common to vary the lift height of an electromagnetic rapper based on its location within the electrostatic precipitator. However, the tumbling hammer systems can only vary the "on" and "off" time of the cycle.

With regard to the force applied, the mechanical force is typically introduced at a periphery of the collecting plate, e.g., the extreme top or bottom of the collecting plate. Consequently, the shock wave caused by that force dissipates as it travels through the collecting plate. To effectively clean the periphery of the collecting plate, it is necessary to impart excessive force to the components nearest the point of initial impact. The excessive force creates a number of problems such as fatigue failures or misalignment, and collected particle re-entrainment into the gas stream. Most attempts at improving the effectiveness of this cleaning approach relate to decreasing the number of collecting plates cleaned by a single hammer device. In this manner, the disparity between the force at the point of introduction to the periphery on the plate is reduced. However, the change increases the cost of the ESP and increases the number of housing openings required for the ESP.

Industrial ESPs use a number of stages or fields in an ESP to remove particles. However, over 85% of the particles are collected in the inlet field collecting plate(s). As a result, the particle layer on these collecting plates will build up quicker compared to subsequent fields. More particularly, at the inlet of the first field, the particles are typically evenly distributed in the vertical plane. As one progresses through the ESP, however, the particles tend to migrate downward increasing the particle density towards the bottom of the collecting plates. This condition results in a relatively even particle thickness from top to bottom at the inlet field collecting plates and a skewed thickness toward the bottom in the outlet field collecting plates. Current cleaning approaches do not address this anomaly.

Acoustic horns have been applied to remove particles from collecting plates.

BRIEF DESCRIPTION OF THE INVENTION

A first aspect of the disclosure provides a system comprising: a resonant frequency modeler for determining a resonant frequency of a node on a collecting plate that collects particles from a gas flow; and a wave generating device that applies a wave having an applied frequency substantially equal to the resonant frequency to the node of the collecting plate to remove particles from the collecting plate.

A second aspect of the disclosure provides an electrostatic precipitator (ESP) comprising: a plurality of substantially parallel collecting plates for positioning in a gas flow; an electrostatic generator for generating an electrostatic charge on or around particles in the gas flow causing them to migrate to at least one of the collecting plates; a cleaning system for the at least one collecting plate, the cleaning system including: a resonant frequency modeler for determining a resonant frequency of a node on the at least one collecting plate; and a wave generating device that applies a wave having an applied frequency substantially equal to the resonant frequency to the node of the at least one collecting plate to remove particles from the collecting plate.

A third aspect of the disclosure provides a method comprising: modeling a resonant frequency of a node on a collecting plate that collects particles from a gas flow; and generating an acoustic wave having an applied frequency that is substantially equal to the modeled resonant frequency for application to the node of the collecting plate to remove particles from the collecting plate.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Figure 1:
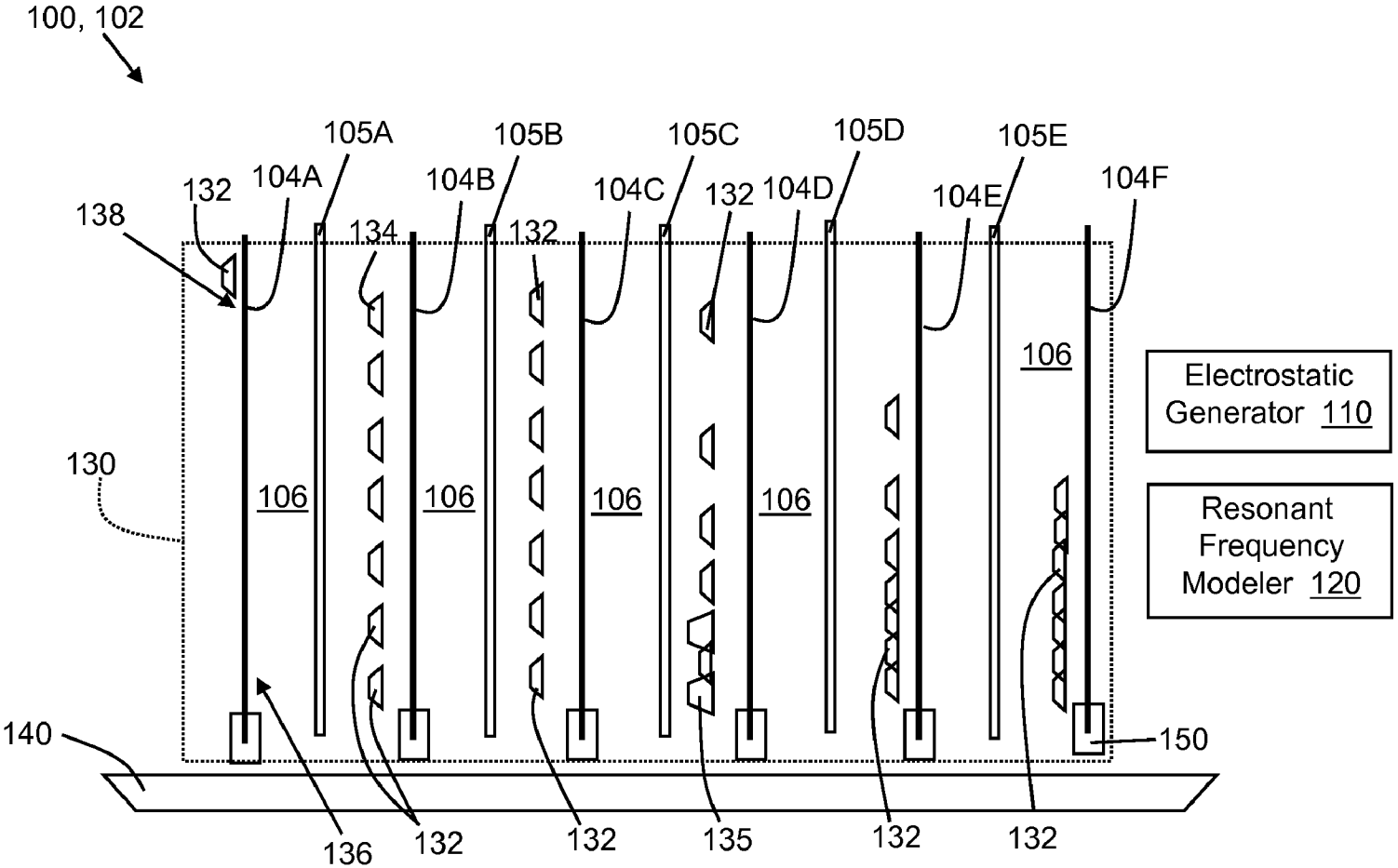
FIG. 1 shows a schematic, cross-sectional view of a system and ESP according to embodiments of the invention.

Referring to the drawings, FIG. 1 shows a schematic cross-sectional view of an electrostatic precipitator (ESP) 100 including a system 102 according to embodiments of the invention. ESP 100 may include a plurality of substantially parallel collecting plates 104A-F positioned in a gas flow 106, which passes into or out of the page. Although six collecting plates 104A-F are illustrated, any number of plates may be employed within the scope of the invention. Collecting plates 104A-F can be any now known or later developed form of metal plates capable carrying an electrostatic charge as created by an electrostatic generator 110. As is understood in the field, as a particle carrying gas flow 106 such as air and/or another gas passes through space between collecting plates 104A-F, particles are pulled from the gas as a result of the electrostatic charge on or near the particles causing the particles to migrate to one or more of collecting plates 104A-F, which are grounded. Particles may include but are not limited to dust, smoke and other toxins. Gas flow 106 is minimally impeded as it passes between collecting plates 104A-F. Electrostatic generator 110 may include any now known or later developed mechanism for generating an electrostatic charge on or near the particles capable of causing the particles to migrate from gas flow 106 to collecting plates 104A-F. For example, it is common to generate corona, electrons and negatively charged ions, using high voltage applied to one or more discharge electrodes 105A-E. Discharge electrodes 105A-D may be, for example, vertically oriented and centered between the adjacent collecting plates 104A-F.

Figure 3:
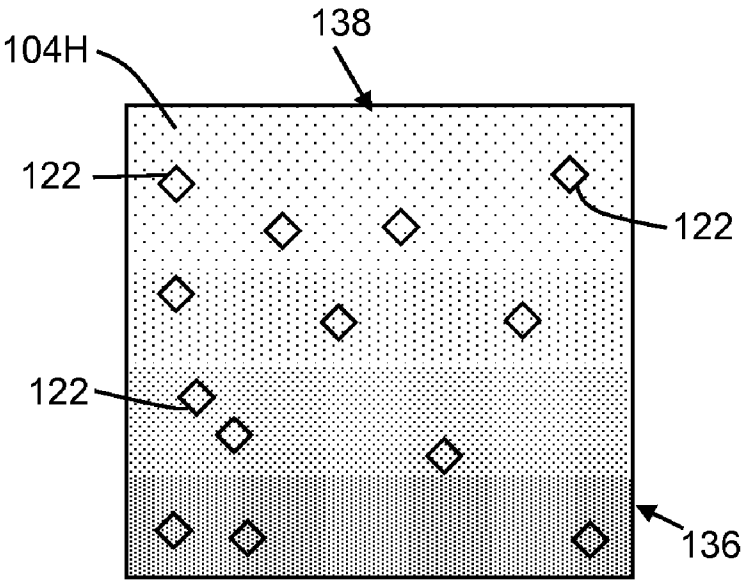
FIG. 3 shows a side view of another illustrative collecting plate.
Figure 2:
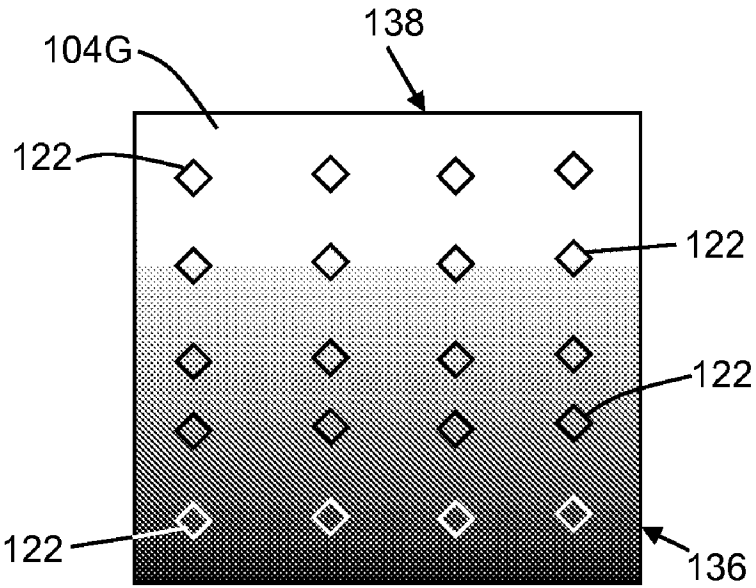
FIG. 2 shows a side view of one illustrative collecting plate.

As is understood, as particles collect on collecting plates 104A-F, the efficacy of the particle collection diminishes, requiring cleaning of the collecting plates. In accordance with embodiments of the invention, system 102 is provided for cleaning at least one collecting plate 104A-F. System 100 includes a resonant frequency modeler 120 for determining a resonant frequency of a node 122 (FIGS. 2-3) on at least one collecting plate 104A-F. Referring to FIGS. 2-3, side views of two illustrative collecting plates 104G and 104H are shown in which the shading indicates an amount of particles on the respective portion of the collecting plate. For example, collecting plate 104G in FIG. 2 is relatively heavily covered with a very heavily covered lower region 136, while collecting plate 104H in FIG. 3 is less covered overall, but has a heavy coverage at a lower region 136 thereof. Nodes 122 are positions or regions on a collecting plate 104 that act as points of reference for system 102. As indicated, nodes 122 may be uniformly distributed across a collecting plate 104G (as in FIG. 2), or may be user defined or randomly selected, as in FIG. 3.

In any event, resonant frequency modeler 120 (FIG. 1) determines a resonant frequency of one or more nodes 122 on at least one collecting plate 104. As used herein, resonant frequency is that frequency for a node 122 at which it oscillates or vibrates at higher amplitude than at other frequencies. There can be more than one resonant frequency for a given collecting plate 104, e.g, depending on numbers of degrees of freedom allowed by the mounting thereof and the amount of particles thereon. Resonant frequency Modeler 120 may employ any now known or later developed modeling technique(s) to determine a resonant frequency of a node 122. For example, the model(s) may employ physically determined or measured samples of resonant frequency at one or more nodes to extrapolate values for other nodes. For example, accelerometers (not shown) can be mounted on collecting plates 104 to define the impact of the applied wave. Some nodes 122 of a plate may be static while other portions respond (e.g., vibrate) at the resonant frequency. Alternatively, model(s) may be based entirely on simulation. Furthermore, the model (s) may include parameters for how resonant frequency changes over time, e.g., as more particles are collected on a collecting plate 104. Different collecting plates 104A-F may be modeled differently, e.g., based on location. The models may also be modified based on experience or observations in the field. In one example, modeler 120 may employ a finite element analysis or other numerical technique for approximating resonant frequency values. Modeling may be performed based on a clean collecting plate 120, i.e., with no particles thereon, and/or with particles already thereon. Models may be created that consider the amount of particles on a collecting plate 104, e.g., based on duration in use, and/or known or expected particle density.

Returning to FIG. 1, system 102 may also include a wave generating device 130 (shown by dashed box) that applies a wave having an applied frequency substantially equal to the resonant frequency of one or more nodes 122 to the respective node(s) 122 of one or more collecting plates 104A-F to remove particles from the collecting plate. Particles falling from collecting plates 104A-F are collected in a hopper 140 therebelow. In one embodiment, the wave may be audible, e.g., although not a definitive range: between about 12 Hz and 20 kHz.

Figure 5:
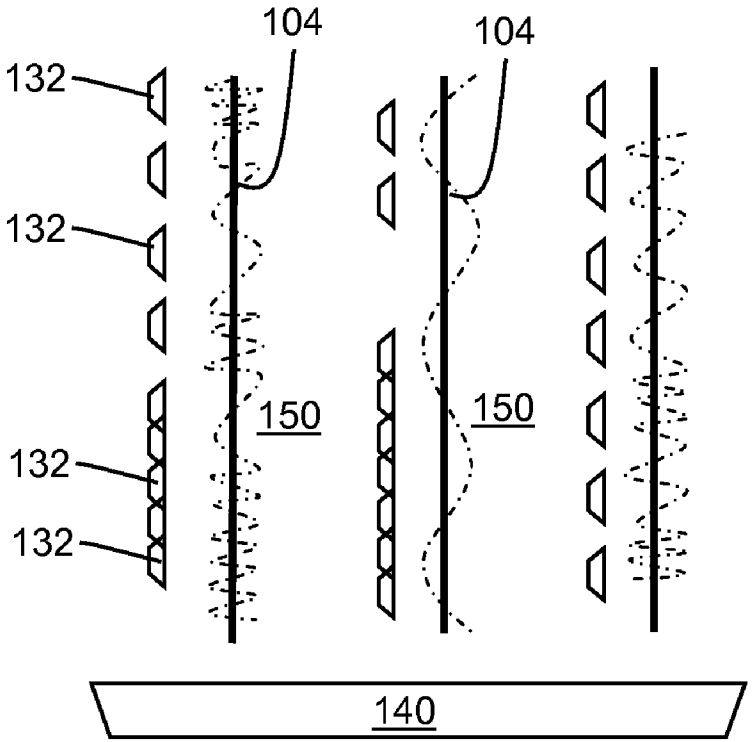
FIG. 5 shows a schematic cross-sectional view of three collecting plates, each having different resonant frequency waves applied along their length.
Figure 4:
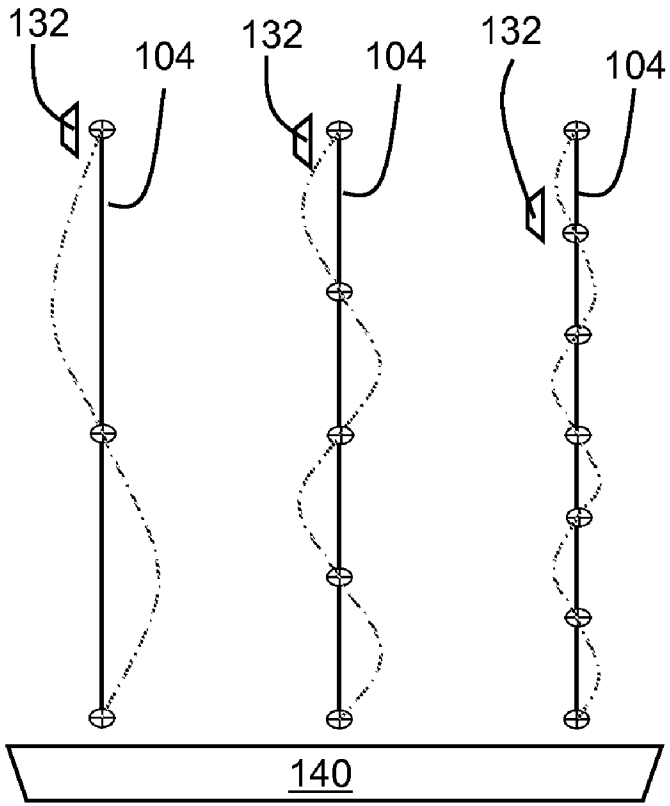
FIG. 4 shows a schematic cross-sectional view of three collecting plates, each having a different resonant frequency wave applied thereto.

Wave generating device 130 may include any now known or later developed device for generating a wave having the requisite resonant frequency to a respective node(s) 122, but does not physically rap, hit or contact the collecting plate. That is, the wave has an applied frequency substantially equal to the resonant frequency. In one embodiment, wave generating device 130 includes one applicator 132 (shown for collecting plate 104A) for a respective collecting plate. FIG. 4 illustrates how applicator 132 on a collecting plate can apply a wave (not shown) with an appropriate resonant frequency to create an appropriate amplitude of vibration (indicated by dashed lines in FIG. 4) across an entire collecting plate 104. However, in another embodiment, wave generating device 130 may include numerous applicators 132 (not all labeled) for a collecting plate (shown for collecting plates 104B-F in FIG. 1). In the latter case, the resonant frequency applied can be customized for each node 122 (FIGS. 2-3) or a collection of nodes 122 of a collecting plate. For example, as shown for collecting plates 104D-F in FIG. 1, more applicators 132 may be positioned near a lower region 136 than an upper region 138 of a collecting plate. This positioning is advantageous because, depending on location in ESP 100, collecting plate 104A-F may collect more particles on lower region 136 thereof than on upper region 138 thereof, e.g., due to particles migrating downwardly due to gravitation forces. (In the illustration, collecting plates such as 104A-C to the left side a more representative of earlier stage collecting plates in an ESP and the collecting plates 140D-F to the right side are more representative of later stage collecting plates in terms of anticipated numbers and positioning of applicators 132, e.g., with less applicators 132 and/or more evenly distributed in earlier stages and applicator 132 concentration increased in lower region 136 in later stages). Alternatively, a single applicator 132 at lower region 136 may provide a different resonant frequency resulting in higher amplitude of vibration at lower region 136 than at upper region 138. In any event, as shown in FIG. 5, each applicator(s) 132 may create a different resonant frequency near a respective node(s) 122 (FIGS. 2-3), resulting in a different amplitude for one node than for another node (shown by dashed lines in FIG. 5—closer lines indicate higher amplitude). It is understood, based on FIGS. 2-3, that applicators 132 are not merely in a line as shown in FIG. 1. That is, they may be arranged across the width, height and length of a collecting plate 104 as are the nodes 122 illustrated in FIGS. 2-3, e.g., in a planar or near planar manner.

In one embodiment, wave generating device 130, i.e., an applicator 132, may include one or more powered diaphragms 134 (only one labeled as such in FIG. 1). Powered diaphragm 134 may be powered by: a compressed gas such as a General Electric PowerWave device which generates a low frequency sound wave (e.g., 0.48-0.62 MPa (70-90 psi)) via a titanium diaphragm as air passes through an edge of the diaphragm. In another embodiment, powered diaphragm 134 may be powered by a compressed gas and fuel such as General Electric PowerWave+ device, which uses a detonation of compressed air with ethylene to create a supersonic shock wave. The above examples are not comprehensive as a variety of other powered diaphragm 134 mechanisms may also be employed within the scope of this invention. Alternatively, power diaphragm 134 may be powered by an electric signal, which may be digital or analog. In addition, as indicated in FIG. 1 by applicator 135 for collecting plate 104D, not all applicators need to be identical, e.g., larger or more powerful applicators may be employed in different nodes 122 (FIGS. 2-3). Furthermore, the distances of applicators 132 from a collecting plate 104 need not be identical.

Although illustrated as within gas flow 106, wave generating device 130 (i.e., applicators 132) may be positioned outside of gas flow 106, so as not to impede the gas flow.

In addition to the above-described structure, system 102 may also include a mechanical force applying device 150 for physically rapping, hitting or contacting a collecting plate. Mechanical force applying device 150 may include any now known or later developed system for rapping or hammering a collecting plate 104A-F. In one embodiment, mechanical force applying device 150 is positioned at lower region 136 of a collecting plate, where physical application of force is advantageous to remove very heavy particle collection.

In operation, resonant frequency modeler 120 models resonant frequency of a node(s) 122 on a collecting plate(s) 104A-F. Based on the model generated, wave generating device 130 applies a wave having an applied frequency substantially equal to the resonant frequency to one or more nodes 122 of one or more collecting plates 104A-F to remove particles from the collecting plate. Where multiple applicators 132 are implemented, wave generating device 130 may apply a different frequency to at least two nodes, e.g., within a single collecting plate 104A-F and/or across different collecting plates 104A-F. Furthermore, wave generating device 130 may change the applied frequency depending on an amount of particles at one or more node(s) 122 on the collecting plate(s) 104A-F, e.g., based on a duration of operation or a model's indication.

An advantage that may be realized in the practice of some embodiments of described systems and technique is that the use of resonant frequency harmonics in a collecting plate 104A-F causes particles to cascade to hopper 140 using the least amplitude, minimizing re-entrainment of collected particles and improving gas cleanliness compliance. System 102 may also assist in reducing emissions and increasing fuel flexibility for certain applications. In addition, the life of internal components may be increased by eliminating fatigue. System 102 is also expected to be less expensive than conventional systems, and reduce the number of openings into a housing used for ESP 100.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A system comprising:

a resonant frequency modeler for determining a resonant frequency of each of a plurality of nodes on a collecting plate that collects particles from a gas flow; and a wave generating device that applies a wave having an applied frequency substantially equal to the resonant frequency corresponding to each of the plurality of nodes of the collecting plate to remove particles from the collecting plate, wherein the wave generating device applies a different frequency to at least two nodes of the plurality of nodes on the collecting plate.

2. The system of claim 1, further comprising a mechanical force applying device for physically rapping the collecting plate.

3. The system of claim 1, wherein the wave generating device includes a powered diaphragm.

4. The system of claim 3, wherein the powered diaphragm is powered by one of: a compressed gas, and a compressed gas and fuel.

5. The system of claim 1, wherein the collecting plate includes particles on at least a surface thereof during the modeling by the resonant frequency modeler.

6. The system of claim 1, wherein the collecting plate includes more particles on a lower region thereof than on an upper region thereof.

7. The system of claim 1, wherein the wave generating device changes the applied frequency depending on an amount of particles at each of the at least two nodes.

8. The system of claim 1, wherein the wave generating device changes the applied frequency depending on an amount of particles at the node on the collecting plate.

9. The system of claim 1, wherein the wave is audible.

10. The system of claim 1, wherein the resonant frequency modeler uses a finite element analysis to determine the resonant frequency of the node.

11. An electrostatic precipitator (ESP) comprising:

a plurality of substantially parallel collecting plates for positioning in a gas flow;

an electrostatic generator for generating an electrostatic charge on or around particles in the gas flow causing them to migrate to at least one of the collecting plates;

a cleaning system for the at least one collecting plate, the cleaning system including:

a resonant frequency modeler for determining a resonant frequency of each of a plurality of nodes on the at least one collecting plate; and a wave generating device that applies a wave having an applied frequency substantially equal to the resonant frequency corresponding to each of the plurality of nodes of the at least one collecting plate to remove particles from the collecting plate, wherein the wave generating device applies a different frequency to at least two nodes of the plurality of nodes on the at least one collecting plate.

12. The ESP of claim 11, further comprising a mechanical force applying device for physically rapping the at least one collecting plate.

13. The ESP of claim 11, wherein the wave generating device includes a powered diaphragm.

14. The ESP of claim 13, wherein the powered diaphragm is powered by one of: a compressed gas, and a compressed gas and fuel.

15. The ESP of claim 11, wherein the wave generating device changes the applied frequency depending on an amount of particles at the node on the at least one collecting plate.

16. The ESP of claim 11, wherein the resonant frequency modeler uses a finite element analysis to determine the resonant frequency of the node.

17. The ESP of claim 11, wherein the wave generating device applies a wave having an applied frequency substantially equal to the resonant frequency of a respective node of each collecting plate to remove particles from each respective node of each collecting plate.

18. A method comprising:

modeling a resonant frequency for each of a plurality of nodes on a collecting plate that collects particles from a gas flow; and generating an acoustic wave having an applied frequency that is substantially equal to the modeled resonant frequency for application to each of the plurality of nodes of the collecting plate to remove particles from the collecting plate, wherein generating the acoustic wave applies a different frequency to at least two nodes of the plurality of nodes on the collecting plate.

* * * * *